US006571526B2

(12) United States Patent
Queen

(10) Patent No.: US 6,571,526 B2
(45) Date of Patent: Jun. 3, 2003

(54) CONCRETE MASONRY UNIT (CMU) VERTICAL REINFORCEMENT AND ANCHOR BOLT POSITIONING DEVICE

(76) Inventor: Frankie A. R. Queen, 221 Three Oaks Dr., Lawrenceville, GA (US) 30245

( * ) Notice: Subject to any disclaimer, the term of this patent is extended or adjusted under 35 U.S.C. 154(b) by 0 days.

(21) Appl. No.: 10/081,069

(22) Filed: Feb. 21, 2002

(65) Prior Publication Data

US 2002/0112437 A1 Aug. 22, 2002

Related U.S. Application Data

(60) Provisional application No. 60/270,394, filed on Feb. 21, 2001.

(51) Int. Cl.[7] ..... E04C 5/16; E04B 2/00

(52) U.S. Cl. ..... 52/677; 52/686; 52/431

(58) Field of Search ..... 52/677, 686, 431, 52/687, 562, 379, 383, 426, 428

(56) References Cited

U.S. PATENT DOCUMENTS 2,020,017 A * 11/1935 Burgess ..... 404/134
3,292,335 A * 12/1966 Stober ..... 52/677
3,694,989 A * 10/1972 Oliver et al. ..... 52/678
4,190,999 A * 3/1980 Hampton ..... 52/442
5,107,654 A * 4/1992 Leonardis ..... 52/677
5,347,787 A * 9/1994 Gavin ..... 248/74.3
5,822,946 A * 10/1998 Rasmussen ..... 248/87
6,089,522 A * 7/2000 Haslem et al. ..... 248/440
6,276,108 B1 * 8/2001 Padrun ..... 52/677
6,354,054 B1 * 3/2002 Verelli et al. ..... 248/440
6,385,938 B1 * 5/2002 Gavin ..... 52/677

* cited by examiner

*Primary Examiner*—Carl D. Friedman
*Assistant Examiner*—Kevin McDermott
(74) *Attorney, Agent, or Firm*—Thomas, Kayden, Horstemeyer & Risley

(57) ABSTRACT

A positioning device for positioning a reinforcement bar within a masonry block. The positioning device includes a core with a central opening and an openable seam, a support structure having support arms connected to the core and arranged and configured for holding the positioning device in a desired position in a cavity of the masonry block. The core is arranged and configured such that a gap can be formed along the seam, the gap being configured to receive the reinforcement bar, and the core encloses the reinforcement bar within the central opening when the gap is closed.

23 Claims, 6 Drawing Sheets

CONCRETE MASONRY UNIT (CMU) VERTICAL REINFORCEMENT AND ANCHOR BOLT POSITIONING DEVICE

CROSS REFERENCE TO RELATED APPLICATION

This application claims the benefit and priority of U.S. Provisional Application Serial No. 60/270,394, filed on Feb. 21, 2001, which is incorporated herein by reference.

BACKGROUND OF THE INVENTION

1. Field of the Invention

The present invention generally relates to positioning vertical reinforcement bars within concrete masonry walls. More specifically, the present invention relates to a positioning device that can be placed around a vertical reinforcement bar after the bar has been positioned within the concrete masonry wall, without having to thread the positioning device over the uppermost end of the reinforcement bar or thread a bar through a positioning device.

2. Description of the Related Art

Concrete masonry is a versatile construction system. Modular by design, concrete masonry walls can economically and readily accommodate adjustments of structural design in the field and to the final design of a construction project. For example, the masonry walls can be formed of concrete blocks that have internal, vertically extending cavities and walls made of the vertically stacked blocks are reinforced by placing rebar or other bars composed of structural grade materials through vertically aligned cavities of the blocks and filling the cavities about the bars of the walls with grout. The grout locks the bars to the blocks and this provides the wall with increased strength and ductility, providing increased resistance to applied loads.

The development of reinforced masonry has allowed the use of tall masonry walls for gymnasiums, warehouses and other like structures. Concrete masonry is well suited to wall construction utilized in load bearing applications due to its inherent durability, compressive strength, economy, and resistance to fire, termites and noise. Empirical design methodology is often used to design plain concrete masonry walls. Concrete masonry walls provide support for the structure above by transferring vertical loads to the footing. Vertical compression counteracts flexural tension thus increasing the walls resistance to flexure. In low-rise construction, these vertical loads are typically small in relation to the compressive strength of concrete masonry. Concrete masonry walls of greater height or concrete masonry walls resisting greater soil loads are typically reinforced.

A typical construction project begins with an excavation for a footing and casting concrete footings against the undisturbed soil. Preferably, reinforcement bars are mounted in the footing, by imbedding the lower ends of the bars in the footing at predetermined intervals along the length of the footing. After the footing has been set, the first course of masonry blocks is laid atop the concrete footing. The first course of masonry blocks is bonded directly to the top of the concrete footing with a full bed of mortar. If the blocks are open ended blocks, at least some of the open ends of the blocks are placed in straddling position about the bars. Otherwise, the cavities of the blocks are threaded downwardly about the bars and placed on the last course of blocks. Subsequent courses are laid on top of the first course and clean out openings are provided in the first course of blocks. Mortar is applied to the upper surfaces of the side walls and to the upper surfaces of the cross webs that extend between the side walls of the blocks to later confine the fluid grout that will be poured into the aligned cavities.

Bar positioners are placed in the internal cavities of blocks of the wall that are occupied by reinforcement bars before the grout is poured down the cavities. The bar positioners are used to make sure the reinforcement bars will be properly positioned in the aligned cavities of the blocks. As the wall increases in height, additional reinforcement bars are required and are spliced to the upper ends of the lower bars and additional bar positioning devices are utilized, as required.

After the vertical steel reinforcement bars are centrally positioned in the aligned cavities of the blocks in the wall, grout is poured into the aligned cavities about the bars and through the positioners to the desired depth. The grout lift is allowed to consolidate and then a second lift of grout is placed and consolidated, if needed. This process continues until the internal cavity to be grouted is completely filled. Grout is an essential element of reinforced concrete masonry block construction. The grout bonds the masonry units to the steel reinforcement so they act together to resist loads.

The proper positioning of the steel reinforcement bar within the grouted cell is a serious problem that goes virtually un-addressed in most field construction operations. Proper positioning of a reinforcement bar within the internal cavity requires maintaining the bar's position both prior to and during grouting operations in order to keep the bar within engineer specified tolerances. Existing products that are available to the engineer and contractor frequently are not used because the products are inefficient, complicated to use, and require time consuming efforts to install them properly.

More specifically, existing steel reinforcement bar positioning devices currently available for use are manufactured of wire and allow for movement of the bar within the internal cavities of a masonry wall. This should concern the engineer in charge of the construction of the wall because of the specified tolerances that are required to be met for reinforcement bar placement. Also, as a wall is being constructed, the typical prior art bar positioning devices have to be threaded longitudinally about a reinforcement bar or else a bar has to be inserted through a previously installed device and dropped into place. Thus, existing bar placement devices are oftentimes not used because they are cumbersome and complicated to use. Also, if the top of a reinforcement bar is too high for a worker to reach in order to thread a positioning device over it and into the desired position, the positioning device is oftentimes purposely and arbitrarily eliminated.

Another problem with the use of most existing bar positioning devices is that the ends of the bar positioning devices are embedded within the mortar joint between two adjacent blocks. This can present a problem in that the placement of the second block on top of the mortar joint that includes the positioning device can affect the position of the positioning device by moving it out of position within the mortared joint. This might cause the bar to be held in an off centered position.

As previously noted, vertical reinforcement bars are frequently required to be inserted into the internal cavities and through the previously installed bar positioners prior to grouting. This means that the bar positioning devices would have to be in place between the masonry blocks as the wall is constructed and once the wall is constructed the reinforcement bars are then blindly threaded through the bar positioning devices. This is a complicated procedure and it is difficult to guarantee that the bar is in its proper position.

The positioning of the reinforcement bars is critical to the quality and structural integrity of the masonry wall. Quality control on-site is often lacking because of labor quality and communication amongst the workforce (masons, ironworkers and laborers). What is needed is a reinforcement bar positioning device capable of holding the reinforcement bars in their proper position prior to grout placement, during the rigorous placement of the cementacious grout and capable of remaining in-place within the monolithic grout column as an integral part of the structure. With this in mind, the positioning device should be manufactured of materials, e.g., steel, plastic, or a combination thereof, compatible with the grouts, masonry block and steel reinforcement. As well, the positioning device should be easy to install, economical to manufacture, economical to ship, and be capable of being placed around and not over a previously positioned reinforcement bar.

BRIEF SUMMARY OF THE INVENTION

Briefly described, the present invention relates to a positioning device for positioning a reinforcement bar within the cavity of a masonry block. The positioning device includes a core with a central cylindrical opening and a longitudinally extending seam. A support structure is connected to the core and arranged and configured for holding the positioning device in a desired position within a cavity of a concrete block. Further, the core is arranged and configured such that a gap can be formed along the seam, the gap being configured to receive and pass laterally about the reinforcement bar so that the reinforcement bar is enclosed within the central opening when the gap is closed.

As well, the present invention includes methods of forming a reinforced wall by positioning a reinforcement bar within a masonry block of the wall using a positioning device. The method includes the steps of placing a cavity of a masonry block about a reinforcement bar, and moving a positioning device laterally into place about the bar and joining the positioning device to the block at the cavity of the block. The positioning device has a core with a central opening for surrounding the bar and the method includes opening the core by creating a gap in the core of the positioning device, placing the positioning device around the reinforcement bar by passing the gap in the core of the positioning device laterally about the reinforcement bar, and closing the core about the bar, thereby enclosing the reinforcement bar within the core. Then the positioning device is mounted in the cavity of the masonry block. This centers the bar in the cavity of the block.

Other systems, methods, features, and advantages of the present invention will be or become apparent to one with skill in the art upon examination of the following drawings and detailed description. It is intended that all such additional systems, methods, features, and advantages be included within this description, be within the scope of the present invention, and be protected by the accompanying claims.

BRIEF DESCRIPTION OF THE SEVERAL VIEWS OF THE DRAWINGS

The accompanying drawings incorporated in and forming a part of the specification illustrate several aspects of the present invention, and together with the description serve to explain the principles of the invention. The components in the drawings are not necessarily to scale, emphasis instead being placed upon clearly illustrating principles of the present invention. In the drawings appended hereto, like numerals illustrate like parts throughout the several views.

DETAILED DESCRIPTION OF THE PREFERRED EMBODIMENT

Figure 1:
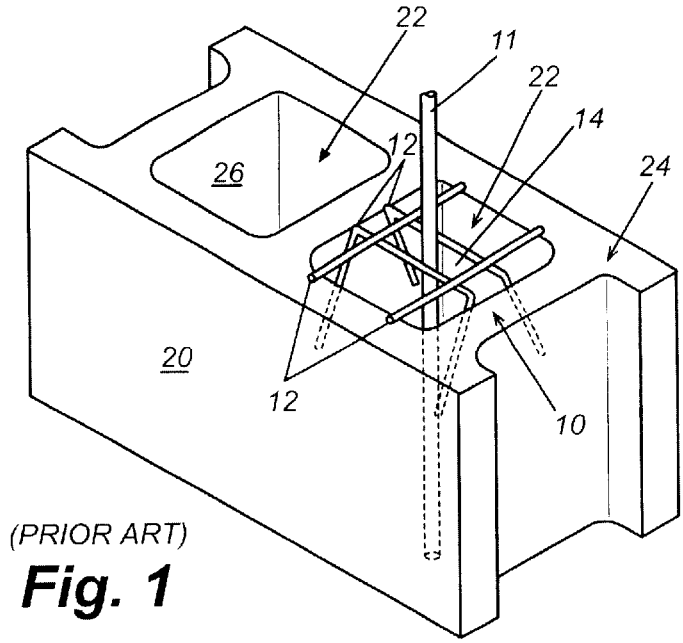
(PRIOR ART) Fig. 1
FIG. 1 is a perspective view of a prior art device for positioning a vertical reinforcement bar within a cavity of a concrete masonry block.

Reference will now be made in detail to the description of the invention as illustrated in the drawings. While the invention will be described in connection with these drawings, there is no intent to limit it to the embodiment or embodiments disclosed therein. On the contrary, the intent is to cover all alternatives, modifications and equivalents included within the spirit and scope of the invention as defined by the appended claims.

As shown in FIG. 1, a prior art positioning device 10 is used to position a vertical reinforcement bar 11 within a masonry block 20. Typically, prior art positioning devices 10 are constructed from metal wire cross members 12 arranged and configured such that a retention space 14 is formed for containing the vertical reinforcement bar 11. Masonry blocks 20 typically include one or more inner cavities 22 in which the vertical reinforcement bar 11 can be placed. Once the desired inner cavity 22 is selected, the prior art positioning device 10 can be installed by contacting the top surface 24 of the masonry block 20 with portions of the wire cross members 12. As well, portions of the metal cross member 12 can be configured to contact the inner surface 26 of the internal cavity 22 and therefore limit lateral movement of the positioning device 10 relative to the masonry block 20. As previously noted, when installing the prior art positioning devices 10, either the retention space 14 must be threaded over the top of a previously installed vertical reinforcement bar 11, or if the positioning device 10 is installed first, the vertical reinforcement bar 11 must be threaded through the retention space 14. Both of which are tedious operations.

Figure 2:
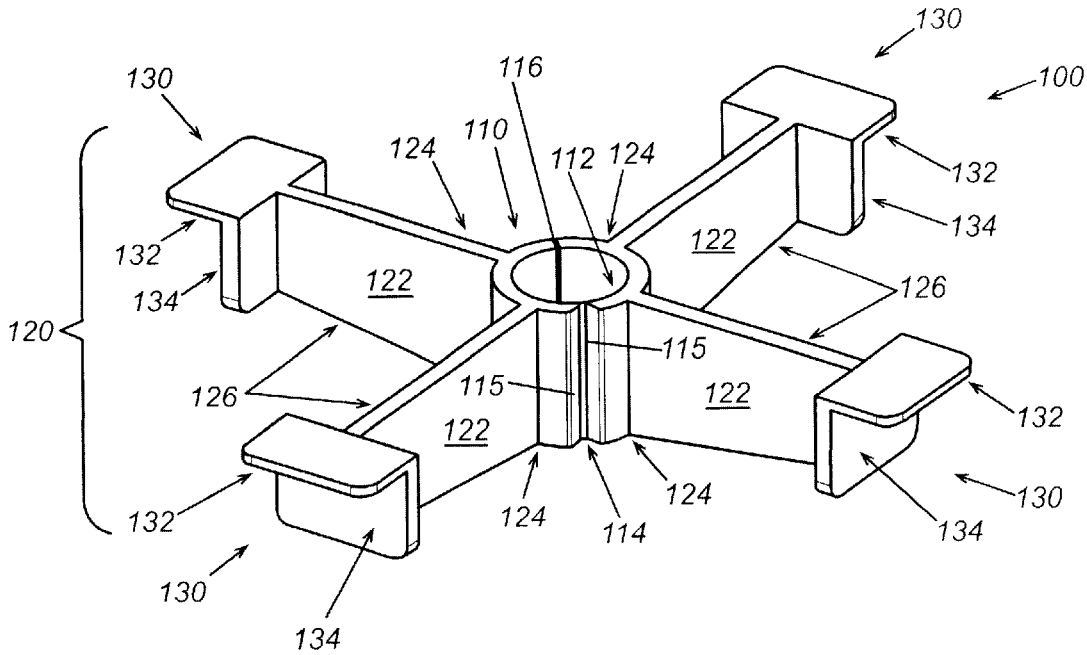
FIG. 2 is a perspective view of the positioning device of the present invention.

An embodiment of a vertical reinforcement positioning device 100, constructed in accordance with the present invention, is shown in FIG. 2. The positioning device 100 includes a core 110 and a support structure 120. Preferably, the core 110 includes a cylindrical central opening 112, a longitudinal seam 114, and a flex joint 116. The seam 114 forms a break in the core and permits a user of the positioning device 100 to form a gap 118 (FIG. 9) in the core 110 by urging apart the pair of opposed edges 115 that form the seam 114. However, embodiments are envisioned wherein the flex joint 116 is not required. Those embodiments are necessarily constructed of materials that allow the opposed edges 115 to be urged apart, thereby forming the gap 118. In a preferred embodiment, the flex joint 116 comprises a thinned section of the core 110 wall. However, "hinge-like" structures can also be used.

Figure 3:
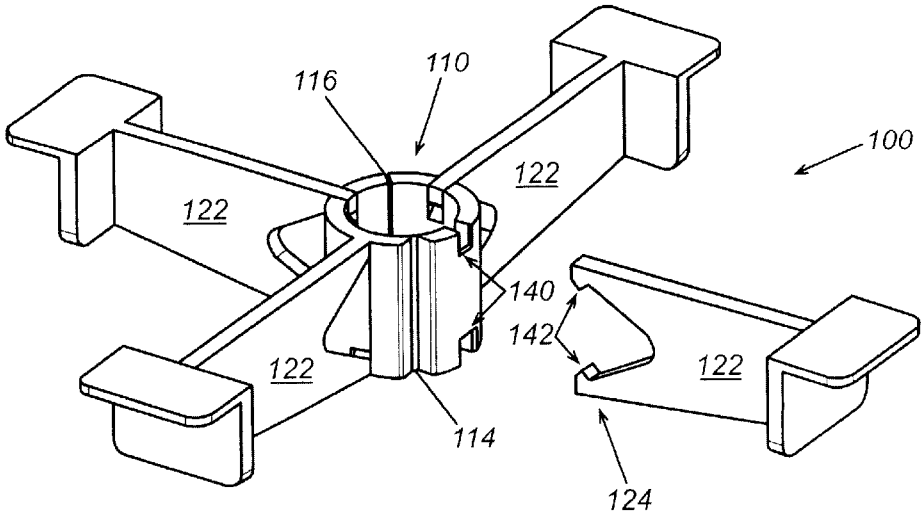
FIG. 3 is a perspective view of another embodiment of the reinforcement positioning device of the present invention.

In the preferred embodiment shown, the support structure 120 includes a plurality of support arms 122, each of the support arms 122 including a proximal end 124 and a distal end 126. Preferably, the positioning device 100 is unitarily constructed, with the proximal end 124 of each support arm 122 being adjacent the core 110 and the support arms 122 extending radially therefrom. Ideally, the positioning device 100 includes four support arms 122 arranged and configured such that opposing pairs of the support arms 122 engage opposing pairs of masonry block side walls 28 (FIG. 11) that form the inner cavity 22 of a masonry block 20. However, embodiments (not shown) of the positioning device 100 are envisioned with as few as two support arms 122 disposed opposite each other. A third support arm 122 can be used in concert with the proceeding embodiment to limit lateral motion of the positioning device 100 relative to the masonry block 20. For example, this configuration is shown in FIG. 3, where only three of the four removable support arms 122 have been attached to the core 110.

In the preferred embodiment of FIG. 1, each support arm 122 includes a mounting flange 130 with a support surface rest 132 and an alignment surface 134 to engage the top surface 24 (FIG. 12) of the masonry block 20, thereby vertically positioning the positioning device 100. The alignment surface 134 of each mounting flange 130 is arranged and configured to engage an inner surface 26 (FIG. 12) of the inner cavity 22. The alignment surfaces 134, acting in concert, limit the amount of lateral motion that is possible between the positioning device 100 and the masonry block 20. Note, the alignment surfaces 134 can be arranged and configured such that the positioning device 100 either slides easily into the interior cavity 22 or fits snugly into the interior cavity 22. Note also that the core 110 in the preferred embodiment is substantially circular in cross-section and has a diameter that is substantially equal to the diameter of the reinforcement bar 11 to be positioned. This is largely due to the fact that standard vertical reinforcement bars 11 (FIG. 1) are substantially circular in cross-section. However, embodiments are envisioned wherein the core 110 has a cross-section other than circular, e.g., square, triangular, oval, etc.

Figure 11:
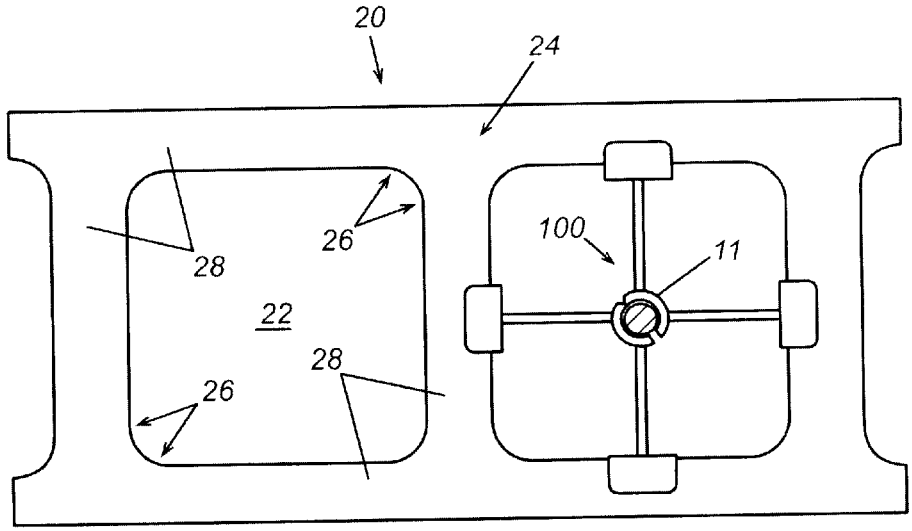
FIG. 11 is a plan view of the positioning device shown in FIG. 10.

Embodiments of the present invention need not be of unitary construction. For example, various embodiments of the vertical reinforcement positioning device 100 of the present invention include removable support arms 122. As shown in FIG. 3, the core 110 includes pairs of support recesses 140, each of which is arranged and configured to cooperate with a corresponding pair of opposed tabs 142 disposed on the proximal end 124 of each support arm 122. Spring action between the pair of opposed tabs 142 secures the support arms 122 in their respective support recesses 140. Various advantages of having removable support arms 122 include reduced space requirements during shipping and adapting the positioning device 100 to accommodate varying sizes of internal cavities 22 (FIG. 11). By having support arms 122 of varying lengths available, a user can attach the required number and size of support arms 122 to the core 110 based on the desired position of the vertical reinforcement bar 11 (FIG. 1) and size of the internal cavity 22.

Figure 4:
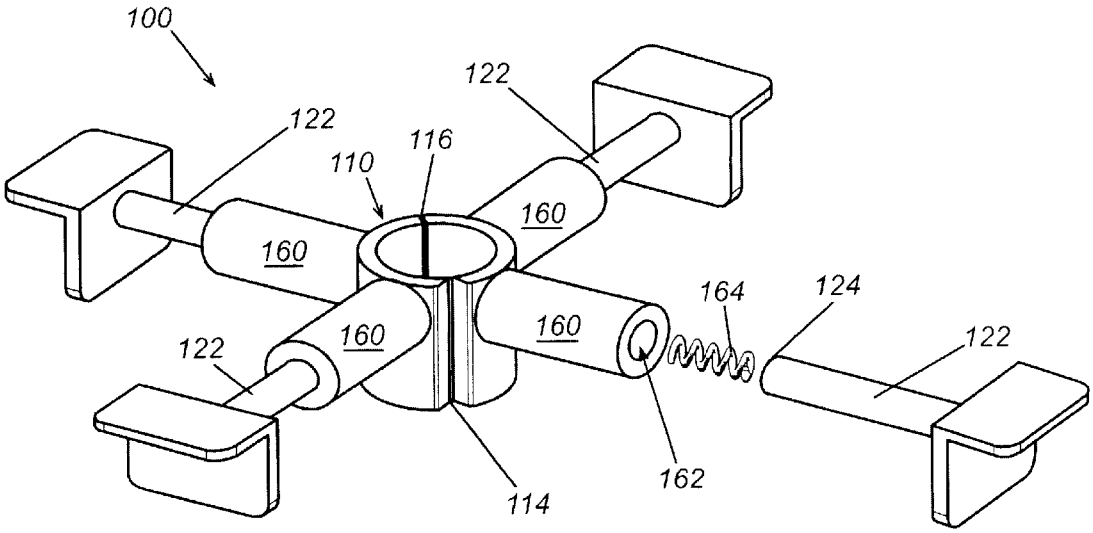
FIG. 4 is a perspective view of another embodiment of the reinforcement positioning device of the present invention.

FIG. 4 shows an embodiment of a positioning device 100 including adjustable support arms 122 for accommodating inner cavities 22 (FIG. 11) of varying size. The core 110 includes a plurality of mounting cylinders 160, each one including a central bore 162 configured to receive the proximal end 124 of a support arm 122. As well, a spring 164 is disposed in each central bore such that the spring 164 is positioned between the core 110 and the proximal end 124 of the respective support arm 122. In this position, the spring 164 can be compressed by pushing inwardly on the support arm 122, thereby allowing the positioning device 100 to be easily inserted into an inner cavity 22 (FIG. 11). Once the positioning device 100 is in place, the inward force on the support arms 122 is released and the springs 164 urge the support arms 122 outwardly such that the alignment surfaces 134 firmly contact the inner surface 26 of the masonry block 20.

Figure 5:
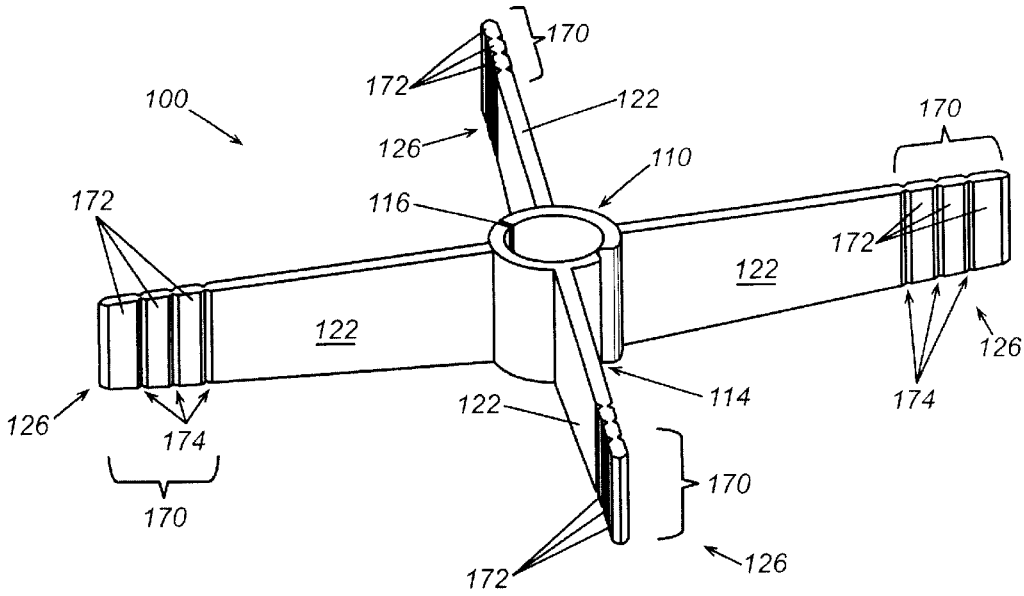
FIG. 5 is a perspective view of another embodiment of the reinforcement positioning device of the present invention.

FIG. 5 shows an embodiment of a positioning device 100 wherein the distal ends 126 of the support arms 122 are flexible tips 170. Each flexible tip 170 includes one or more segments 172, adjacent segments 172 being separated by indentations 174 such that each of the flexible tips 170 can be forcibly bent out of alignment with its respective support arm 122. In use, the positioning device 100 is first placed around a vertical reinforcement bar 11 and then positioned inside the inner cavity 22 (FIG. 11). Next, the positioning device 100 is rotated such that the flexible tips 170 come into contact with the inner surface 26 of the masonry block 20. After contact is made, force is exerted until the flexible tips 170 begin to bend along the indentations 174. With the flexible tips 170 so positioned, the positioning device is effectively "wedged" into the inner cavity 22. Forming the positioning device of plastic is preferable in that plastic allows the flexible tips 170 to bend as desired.

The positioning device 100 shown in FIG. 5 can also be formed of materials that do not provide flexibility. In this case, the segments 172 can be broken off the support arms 122 along the indentations 174 as necessary to approximate the internal dimensions of the inner cavity 22. The positioning device 100 is then positioned around the vertical reinforcement bar 11, and "wedged" into the inner cavity 22. As with the embodiment including flexible tips 170, this embodiment of the positioning device 100 is located totally within the inner cavity 22 after it has been positioned, thereby leaving the masonry joint between adjacent masonry blocks 20 free of the positioning device 100. This allows other devices, e.g., flashing, horizontal reinforcement, etc., to be placed in the mortar joint without interfering with the placement of the positioning device 100. Also, because the positioning device 100 is located totally within the inner cavity 22, its position does not depend on the proper placement of an adjacent masonry block 20.

Figure 6:
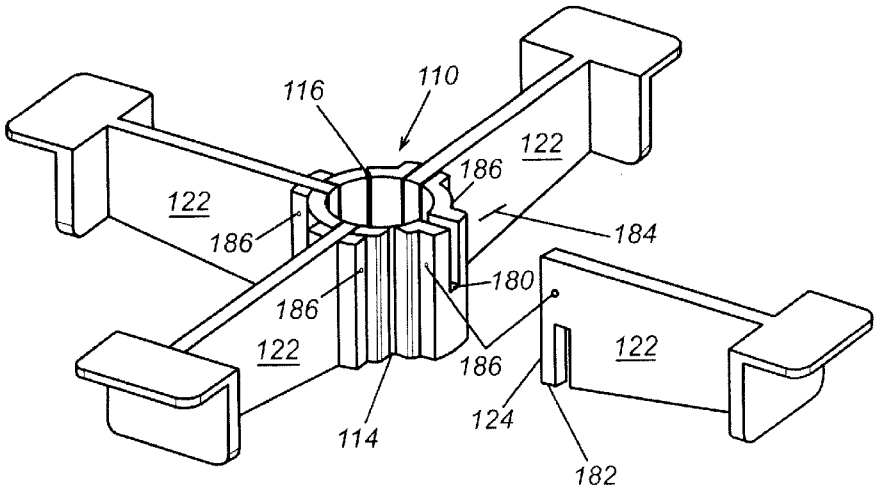
FIG. 6 is a perspective view of another embodiment of the reinforcement positioning device of the present invention.

FIG. 6 discloses another embodiment of the present invention that includes removable support arms 122. As shown, the core 110 includes a plurality of mounting slots 180, and each of the mounting slots 180 is arranged and configured to receive a mounting pin 182 disposed on the proximal end 124 of each support arm 122. To attach each support arm 122 to the core 110, each mounting pin 182 slidably engages a corresponding mounting slot 180. To secure each support arm 122 in place, a retention member 184 can be passed through matching retention orifices 186 formed in both the core 110 and the proximal end 124 of the support arms 122.

Figure 7:
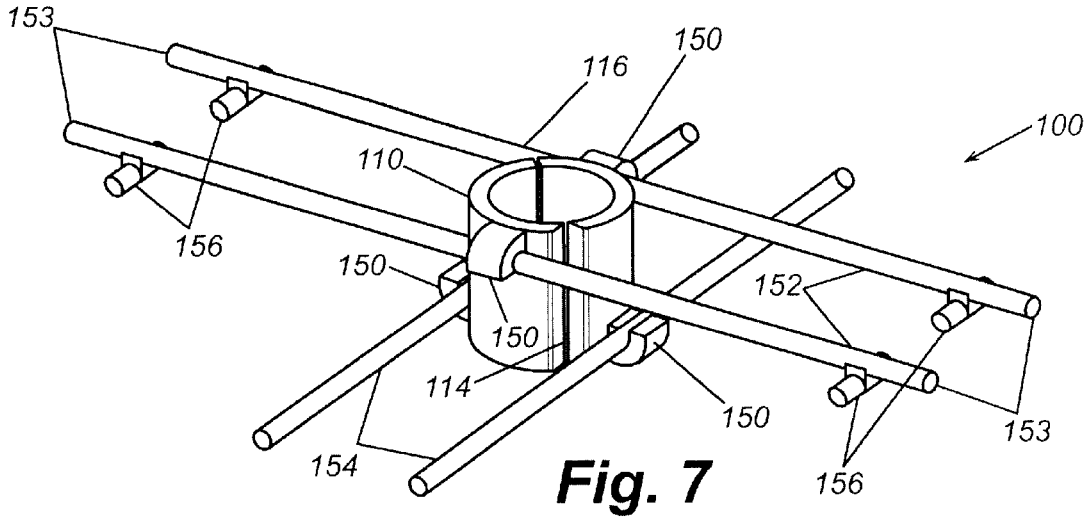
FIG. 7 is a perspective view of another embodiment of the reinforcement positioning device of the present invention.

FIG. 7 shows an embodiment of a positioning device 100 wherein the support structure includes a pair of vertical support members 152 and a pair of horizontal alignment members 154 releasably attached to the core 110. The vertical support and horizontal alignment members 152, 154 are attached to the core 110 with support hooks 150. Although the positioning device 100 need only have one vertical support member 152 and one horizontal alignment member 154, preferably, a pair of each is used. The vertical support members 152 are selected such that their length is slightly greater than the related dimension of the inner cavity 22 (FIG. 11) into which the vertical reinforcement bar 11 is to be placed. As such, the tips 153 of the vertical support members 152 will contact the top surface 24 (FIG. 11) of the masonry block 20. Alignment stubs 156 may also be used to limit the lateral motion between the vertical support members 152 and the masonry block 20. The horizontal alignment members 154 are selected such that their length is slightly less than associated dimension of the inner cavity 22. In this manner, the horizontal alignment members 154 fit readily inside the inner cavity 22, yet limit the amount of lateral motion between the positioning device 100 and the masonry block 20.

Figure 8:
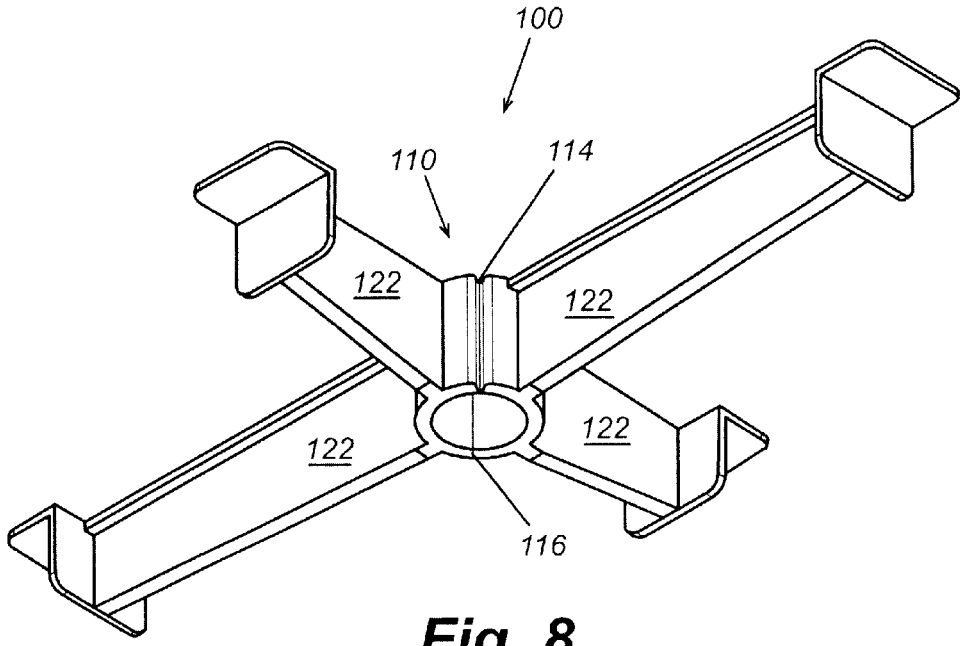
FIG. 8 is a perspective view of another embodiment of the reinforcement positioning device of the present invention.

FIG. 8 shows a unitarily constructed positioning device, configured for an internal cavity 22 (FIG. 11) wherein one dimension is longer than the second.

OPERATION

Figure 9:
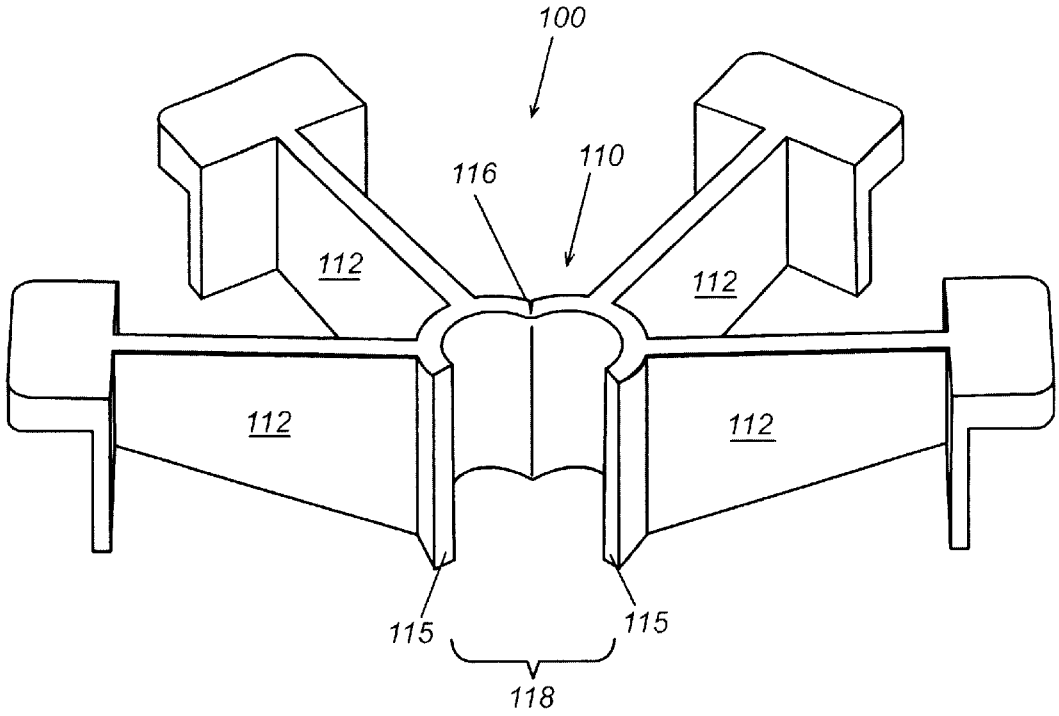
FIG. 9 illustrates a perspective view of the positioning device shown in FIG. 1, with the core in an open position.
Figure 10:
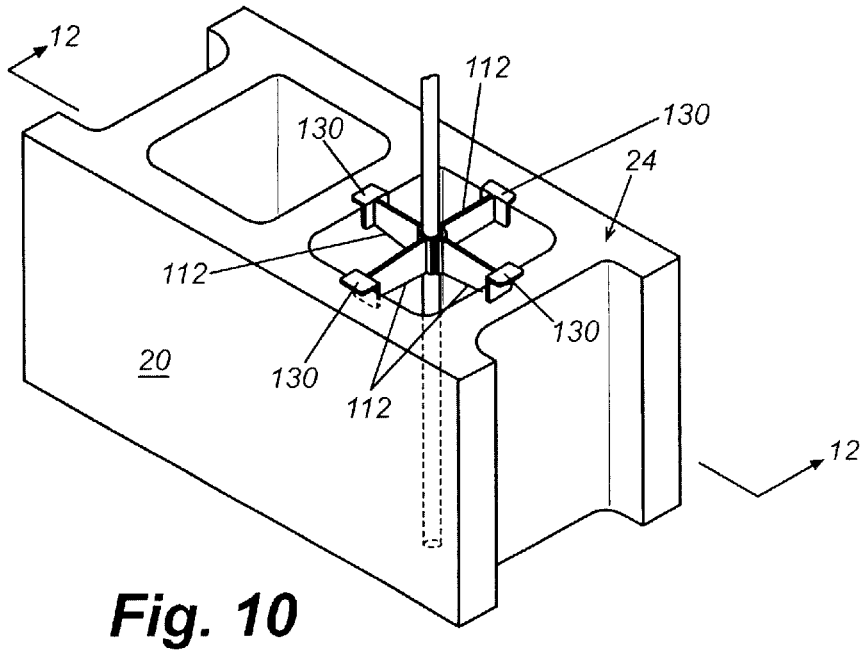
FIG. 10 is a perspective view of the positioning device mounted in a cavity of a block and mounted about a reinforcement bar.

As shown in FIG. 9, when installing an embodiment of the present positioning device 100, the opposed edges 115 forming the seam 114 on the core 110 are urged apart, thereby forming a gap 118 in the core 110 that is configured to receive a vertical reinforcement bar 11 (FIG. 10). As previously noted, preferably, a flex joint 116 is provided to facilitate forming the gap 118 in the core 110. Next, the positioning device 100 is placed around the vertical reinforcement bar 11 by passing the bar 11 through the gap 118. Once around the vertical reinforcement bar 11, the opposed edges 115 are urged together so that the vertical reinforcement bar 11 is enclosed within the central opening 112 formed by the core 110.

Next, as shown in FIG. 10, the positioning device 100 is slid downwardly along the vertical reinforcement bar 11 until the support surfaces 132 (FIG. 12) of the mounting flanges 130 contact the top surface 24 of the masonry block 20. Once the vertical reinforcement bar 11 is in the desired position within the masonry block 20, liquid grout can be poured about the vertical reinforcement bar 11. By engaging the masonry block 20 as depicted in FIG. 10, the mounting flanges 130 insure that the vertical reinforcement bar 11 is held in position during both the pouring and settling of the liquid grout.

Figure 12:
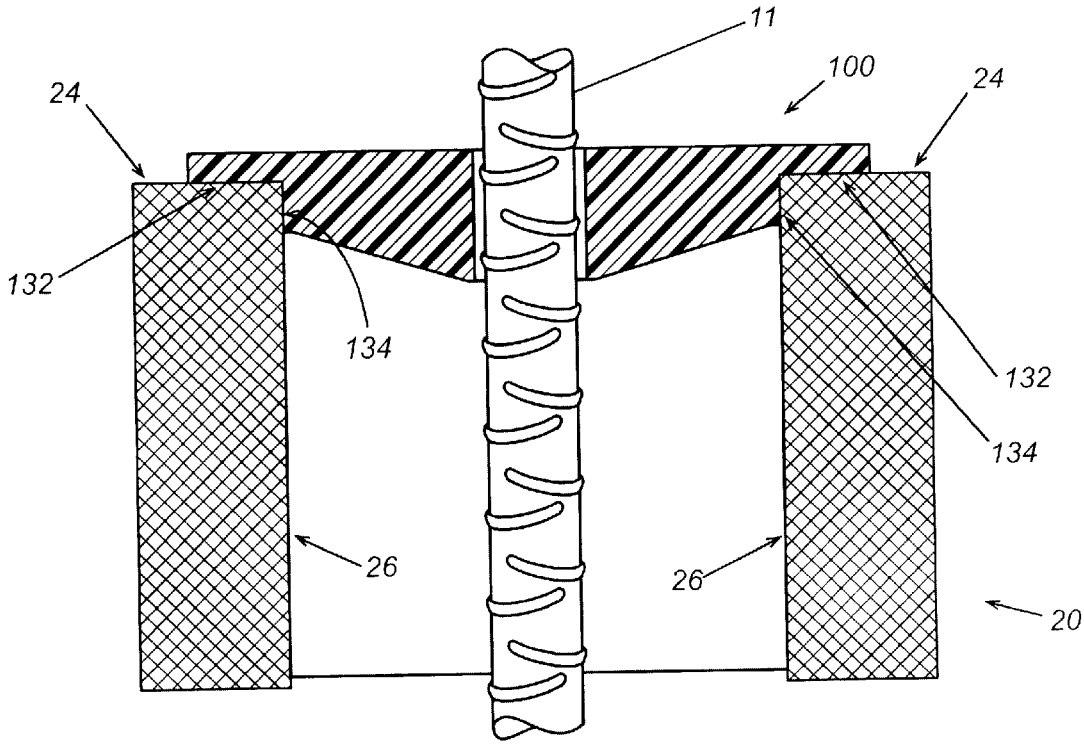
FIG. 12 is a partial cross-sectional view of the positioning device as shown in FIG. 10 taken along line 12—12.

FIG. 11 shows the vertical reinforcement bar 11 positioned equidistant from the side walls 28 of the masonry block 20. The positioning device 100 maintains the vertical reinforcement bar 11 in the desired position due to interaction of the alignment surfaces 134 with the inner surface 26 of the masonry block 20, as shown in FIG. 12.

It should be emphasized that the above-described embodiments of the present invention, particularly, any "preferred" embodiments, are merely possible examples of implementations, merely set forth for a clear understanding of the principles of the invention. Many variations and modifications may be made to the above-described embodiment(s) of the invention without departing substantially from the spirit and principles of the invention. All such modifications and variations are intended to be included herein within the scope of this disclosure and the present invention and protected by the following claims.

What is claimed is:

1. A positioning device for positioning a reinforcement bar within a masonry block having a top surface, an inner cavity and an inner surface, said positioning device comprising:

a core having a central opening and a seam;

a support structure connected to said core and said support structure being disposed on the top surface of the masonry block and arranged and configured for holding said positioning device aligned with an inner cavity of the block; and wherein said core is arranged and configured such that a gap can be formed along said seam, said gap being configured to receive the reinforcement bar, said core enclosing the reinforcement bar within said central opening when said gap is closed.

2. The positioning device of claim 1, wherein said core is a cylindrical tube.

3. The positioning device of claim 1, wherein said core is a square tube.

4. The positioning device of claim 1, wherein said core further comprises a flex joint, said flex joint being arranged and configured to facilitate forming said gap.

5. The positioning device of claim 1, wherein said support structure further comprises:

a plurality of support arms, each of said plurality of support arms having a proximal end and a distal end, said proximal end being adjacent to said core and said distal end extending radially from said core.

6. The positioning of claim 5, wherein said distal end of each of said support arms further comprises a flex tip, each of said flex tips being arranged and configured such that said flex tips bendably engage the inner surface, thereby maintaining said device in said desired position.

7. A positioning device for positioning a reinforcement bar within a masonry block , with the block having a top surface, an inner cavity and an inner surface, comprising:

a core having a central opening and a seam;

a support structure connected to said core including a plurality of support arms, each of said support arms having a proximal end and a distal end, said proximal end being adjacent said core and said distal end extending radially from said core and arranged and configured for holding said positioning device in a desired position on the block;

said core arranged and configured such that a gap can be formed along said seam, said gap being configured to receive the reinforcement bar, said core enclosing the reinforcement bar within said central opening when said gap is closed;

said distal end of each of said support arms comprising a flex tip;

each of said flex tips including a plurality of segments with an indentation formed between adjacent ones of said segments; and each of said flex tips being arranged and configured such that said flex tips bendably engage the inner surface of the block, thereby maintaining said device in a desired position with respect to the block.

8. A positioning device for positioning a reinforcement bar within a masonry block having a top surface and an inner cavity, said positioning device comprising:

a core having a central opening and a seam;

said core arranged and configured such that a gap can be formed along said seam, said gap being configured to receive the reinforcement bar, said core enclosing the reinforcement bar within said central opening when said gap is closed;

a support structure connected to said core;

said support structure including a plurality of support arms, each of said support arms having a proximal end and a distal end, said proximal end being adjacent said core and said distal end extending radially from said core and arranged and configured for holding said positioning device in a desired position in an inner cavity of the block;

at least one of said plurality of support arms further comprising a mounting flange disposed at said distal end, said mounting flange including a support surface and an alignment surface; and wherein said support surface is arranged and configured to abut the top surface of the block, and said alignment surface is arranged and configured to abut the cavity of the block.

9. The device of claim 8, wherein said plurality of support arms further comprises four radially extending support arms, and each of said support arms is spaced equidistant about said core and includes said mounting flange.

10. The device of claim 8, wherein said plurality of support arms is formed integrally with said core.

11. The device of claim 10, wherein said device is constructed of plastic.

12. A positioning device for positioning a reinforcement bar within a masonry block having a top surface, an inner cavity and an inner surface, said positioning device comprising:

a core having a central opening and a seam;

a support structure connected to said core and arranged and configured for holding said positioning device in a desired position;

said core arranged and configured such that a gap can be formed along said seam, said gap being configured to receive the reinforcement bar, said core enclosing the reinforcement bar within said central opening when said gap is closed;

a plurality of support arms, each of said plurality of support arms having a proximal end and a distal end, said proximal end being adjacent said core and said distal end extending radially from said core;

each of said plurality of support arms being detachably connected to said core.

13. The device of claim 12, further comprising:

a mounting pin formed on said proximal end of each of said plurality of support arms;

a plurality of mounting slots formed on said core; and wherein each of said plurality of support arms is secured to said core by slidably engaging one of said plurality of mounting slots with said mounting pin.

14. A positioning device for positioning a reinforcement bar within a masonry block having a top surface, an inner cavity and an inner surface, said positioning device comprising:

a core having a central opening and a seam;

a support structure connected to said core and arranged and configured for holding said positioning device in a desired position;

said core arranged and configured such that a gap can be formed along said seam, said gap being configured to receive the reinforcement bar, said core enclosing the reinforcement bar within said central opening when said gap is closed;

a plurality of support arms, each of said plurality of support arms having a proximal end and a distal end, said proximal end being adjacent said core and said distal end extending radially from said core;

a pair of opposed tabs formed on said proximal end of each of said plurality of support arms; and wherein each of said plurality of support arms is secured to said core by engaging a pair of support recesses disposed on said core with said pair of opposed tabs.

15. A positioning device for positioning a reinforcement bar within a masonry block having a top surface, an inner cavity and an inner surface, said positioning device comprising:

a core having a central opening and a seam;

a support structure connected to said core and arranged and configured for holding said positioning device in a desired position;

said core arranged and configured such that a gap can be formed along said seam, said gap being configured to receive the reinforcement bar, said core enclosing the reinforcement bar within said central opening when said gap is closed;

a plurality of support arms, each of said support arms having a proximal end and a distal end, said proximal end being adjacent said core and said distal end extending radially from said core;

a plurality of mounting cylinders disposed on said core, each of said plurality of mounting cylinders having a central bore and extending radially outward from said core; and wherein said central bore is arranged and configured to slidably receive said proximal end of one of said plurality of support arms.

16. The device of claim 15, wherein each of said plurality of mounting cylinders further includes a spring disposed within said central bore, said spring being arranged and configured to urge an associated one of said plurality of support arms away from said core.

17. A positioning device for positioning a reinforcement bar within a masonry block having a top surface, an inner cavity and an inner surface, said positioning device comprising:

a core having a central opening and a seam;

said core arranged and configured such that a gap can be formed along said seam, said gap being configured to receive the reinforcement bar, said core enclosing the reinforcement bar within said central opening when said gap is closed;

a support structure connected to said core and arranged and configured for holding said positioning device in a desired position;

said support structure further comprising:

at least one vertical support member;

at least one horizontal alignment member; and wherein said at least one vertical support member and said at least one horizontal alignment member are each releasably connected to said core by a support hook such that each of said at least one vertical support members is perpendicular to each of said at least one horizontal alignment members.

18. The device of claim 17, further comprising two vertical support members and two horizontal alignment members.

19. A method of positioning a reinforcement bar within a masonry block during the construction of a wall using a positioning device having a core defining a cylindrical opening, the masonry block having a top surface, an inner cavity, and an inner surface, the method comprising the steps of:

placing the cavity of a masonry block and a reinforcement bar of a partially completed wall in positions so that the cavity of the masonry block surrounds the reinforcement bar;

creating a gap in a core of a positioning device to open the central opening of the positioning device;

placing the central opening of the core of the positioning device around the reinforcement bar by passing the gap of the core of the positioning device about the reinforcement bar;

closing said gap of the core, thereby closing the core of the reinforcement bar about the bar;

supporting the positioning device with the top surface of the masonry block; and inserting at least a portion of said positioning device into the inner cavity of the masonry block.

20. The method of claim 19, wherein said step of creating said gap further includes bending said core along a flex joint.

21. The method of claim 20, further including the step of frictionally engaging the inner surface of a cavity of the masonry block with said positioning device.

22. The method of claim 20, wherein the step of supporting the positioning device with the top surface of the masonry block comprises:

placing a plurality of support surfaces of the positioning device adjacent the top surface of the masonry block, each of said plurality of support surfaces being disposed on a support arm extending radially from said core.

23. The method of claim 22, further comprising the step of:

limiting the range of horizontal motion of said positioning device within the inner cavity.

* * * * *